US009557092B1

(12) United States Patent
Heussner

(10) Patent No.: US 9,557,092 B1
(45) Date of Patent: Jan. 31, 2017

(54) SUB-0 HOME FREEZER

(71) Applicant: Edward Robert Heussner, Warren, MI (US)

(72) Inventor: Edward Robert Heussner, Warren, MI (US)

( * ) Notice: Subject to any disclaimer, the term of this patent is extended or adjusted under 35 U.S.C. 154(b) by 0 days.

(21) Appl. No.: 14/665,003

(22) Filed: Mar. 23, 2015

(51) Int. Cl.
*F25D 11/00* (2006.01)
*F25D 11/04* (2006.01)
*F25D 3/08* (2006.01)

(52) U.S. Cl.
CPC ..... *F25D 11/04* (2013.01); *F25D 3/08* (2013.01); *F25D 2400/12* (2013.01); *F25D 2400/30* (2013.01)

(58) Field of Classification Search
CPC ..... F25D 11/04; F25D 3/08; F25D 2400/10; F25D 2400/30
See application file for complete search history.

(56) References Cited

U.S. PATENT DOCUMENTS 1,511,824 A 10/1924 Birdseye
1,977,373 A 4/1925 Birdseye
1,773,079 A 8/1930 Birdseye
1,773,080 A 8/1930 Birdseye
1,817,890 A 8/1931 Birdseye
1,822,124 A 9/1931 Birdseye
1,852,228 A 4/1932 Birdseye
1,880,232 A 10/1932 Birdseye
1,924,903 A 8/1933 Birdseye
1,955,484 A 4/1934 Birdseye
1,998,431 A 4/1935 Birdseye
2,014,550 A 9/1935 Birdseye
2,603,071 A * 7/1952 Kalhoefer ..... F25D 11/00 62/229
5,367,887 A * 11/1994 Byrd ..... F25D 13/067 62/266

(Continued)

FOREIGN PATENT DOCUMENTS

EP 1074803 A2 7/2001
EP 1457748 A2 9/2004

OTHER PUBLICATIONS

Editors at America's Test Kitchen—"Cooks Illustrated Meat Book", Copyright 2014 by the Editors at America's Test Kitchen. Specifically p3—Quick Chilling Tip.

(Continued)

*Primary Examiner* — Elizabeth Martin

(57) ABSTRACT

An occasional use domestic counter top flash freezer. To accomplish this, all aspects of the refrigeration process have been scaled down into a unique and economical flash freezer for the home, here to for unavailable to the consumer. A refrigeration engine is contained within a light weight and low cost enclosure; and chills a diminutive cold chamber to temperatures substantially below −18° C. The cold chamber is sized to accommodate a small batch of foodstuffs at a time, such that the rate of heat removal effects flash freezing; the process of preventing formation of large cellular ice crystals. This appliance is an adjunct to a domestic home refrigerator/freezer, enabling the consumer, for the first time, to effectively freeze foodstuffs for later consumption, while not sacrificing taste! Thus, it will do for food preservation what the microwave has done for food preparation in the home.

3 Claims, 2 Drawing Sheets

(56) References Cited

U.S. PATENT DOCUMENTS

| | | | | |
|---|---|---|---|---|
| 6,397,620 | B1 | 6/2002 | Kelly | |
| 6,675,603 | B1 * | 1/2004 | Lesyna | F25D 17/065 62/258 |
| 7,617,699 | B1 * | 11/2009 | Parmely | F25B 15/00 62/110 |
| 7,628,029 | B2 | 12/2009 | Yamada | |
| 7,810,340 | B2 | 10/2010 | Owada | |
| 2009/0113899 | A1 * | 5/2009 | Dain | F25D 11/04 62/48.1 |
| 2009/0229299 | A1 * | 9/2009 | Tonon | F25D 23/003 62/465 |
| 2014/0041408 | A1 * | 2/2014 | Martinez Aroca | F25B 39/02 62/340 |

OTHER PUBLICATIONS

Steven Johnson, "How we got to now," Penguin Group, Copyright 2014, and PBS TV series, of same name Nov. 2014. Specifically "Cold" chapter, pp. 45-85.

"Six Chix," syndicated comic strip, by Isabella Bannerman, Published Feb. 26, 2015.

Rudy Stegmann, PE, "Practical Guide—Low Temperature Refrigeration", Air Conditioning and Refrigeration Journal, Jul.-Sep. 2000.

King, Guy R., "Basic Refrigeration," Business News Publishing Company, Troy Michigan, Copyright 1986.

Althouse, Andrew Danial, "Modern Refrigeration and Air Conditioning," The Goodheart-Wilcox Company, Inc. Copyright 2000.

* cited by examiner

SUB-0 HOME FREEZER

BACKGROUND

Prior Art

U.S. & Foreign Patents

| Pat. No. | Kind Code | Issue Date | Patentee | Purpose |
|---|---|---|---|---|
| 1,511,824 | B1 | 14 Oct. 1924 | Birdseye | Historical Ref |
| 1,773,079 | B1 | 12 Aug. 1930 | Birdseye | " |
| 1,773,080 | B1 | 12 Aug. 1930 | Birdseye | " |
| 1,817,890 | B1 | 4 Aug. 1931 | Birdseye | " |
| 1,822,124 | B1 | 8 Sep. 1931 | Birdseye | " |
| 1,852,228 | B1 | 5 Apr. 1932 | Birdseye | " |
| 1,880,232 | B1 | 4 Oct. 1932 | Birdseye | " |
| 19249036 | B1 | 29 Aug. 1933 | Birdseye | " |
| 1,955,484 | B1 | 17 Apr. 1934 | Birdseye | " |
| 1,998,431 | B1 | 23 Apr. 1925 | Birdseye | " |
| 2,014,550 | B1 | 17 Sep. 1935 | Birdseye | " |
| U.S. 6,397,620 B2 | B2 | 4 Jun. 2002 | Kelly | Vacuum Insulation Pnl |
| U.S. 7,810,340 | B2 | Oct. 12, 2010 | Owada | Effect of Flash Freezing |
| U.S. 7,628,029 B2 | B2 | 8 Dec. 2009 | Yamada | Home Flash Freezer |
| EP 1,074,803 | A2 | Jul. 2, 2001 | Fumagalli | Home Flash Freezer |
| EP 1,457,748 | A2 | Sep. 15, 2004 | Marega | Home Flash Freezer |

NONPATENT LITERATURE DOCUMENTS

Althouse, Andrew Danial, "Modern Refrigeration and Air Conditioning," The Goodheart-Wilcox Company, Inc. Copyright 2000.

King, Guy R., "Basic Refrigeration," Business News Publishing Company, Troy Mich., Copyright 1986.

Rudy Stegmann, P E, "Practical Guide—Low Temperature Refrigeration", Air Conditioning and Refrigeration Journal, July-September 2000.

Editors at America's Test Kitchen—"Cooks Illustrated Meat Book", Copyright 2014 By the Editors at America's Test Kitchen. Specifically p 3—Quick Chilling Tip.

Steven Johnson, "How we got to now," Penguin Group, Copyright 2014, and PBS TV series, of same name November 2014. Specifically "Cold" chapter, pp 45-85.

"Six Chix," syndicated comic strip, by Isabella Bannerman, Published 26 Feb. 2015.

Internet Search Results {A Partial Listing}

Extensive search at the USPTO and Google web sites turned up numerous prior art patents, applicable results were noted above.

Google searches on terms such as: "low temp freezers", "flash freezing", "ultra low temp freezers", "freezer burn" and other terms resulted in numerous articles on long term food storage, several articles of note include:

Loc.gov/rescitech/mysteries/freezerburn.html

Fsis.usda.gov/factsheets/focus_on_freezing/index.asp

Helpwithcooking.com/food-storage/freezing-food.html http://www.stilltasty.com/ {A web site that identifies appropriate shelf life for all foods; in all instances foodstuffs will keep indefinitely in the home freezer. However they also report that for many foodstuffs taste will deteriorate over time.}

INTRODUCTION

The embodiments described herein refer to a revolutionary new approach empowering the consumer to flash freeze their own home cooked or fresh foodstuffs for later consumption. Flash freezing means to remove heat from foodstuffs at a rate sufficient to prevent formation of large ice crystals. Flash freezing has been employed by all major food processors for nearly a century. The home freezer is capable of preserving frozen foodstuffs indefinitely, however, when initially freezing foodstuffs in the home freezer, large ice crystals will form, degrading the taste upon thawing. These two facts were first observed and put into practice by Clarence Birdseye in the late 1920's. Johnson, in his history of "How We Got To Now," book and TV series {ref above} considered that Birdsye's findings had a positive revolutionary effect on how America eats healthier. Also, as recent as their 2014 cook book {ref above}, the editors at America's Test Kitchen, were recommending a convoluted method of "Quick Chilling" meats to minimize formation of large ice crystals, based upon a combination of salt and ice cubes. This organization prides itself in using the scientific method to optimize the taste of home prepared meals. With the exception of window air-conditioners "refrigeration engine" systems are designed to operate continuously and maintain per-determined temperatures inside an enclosure. To accomplish flash freezing for the consumer, as presented herein, all aspects of the refrigeration process have been scaled down into a unique and economical occasional use free standing flash freezer for the home. Presently no such solution is available to the consumer.

A Brief History

Using cold to preserve foodstuffs has been known for centuries. To wit, thru the late 19th century ice was harvested from Northern lakes in the winter and shipped around the world as the primary means of refrigeration. Late in the $19^{th}$, century mechanical ice making became a reality.

The basic technologies for mechanically producing cold have been known for nearly two centuries. There are three basic approaches, they include: the vapor-compression cycle {first demonstrated in 1834} and the most common today; thermoelectric also discovered in 1834; and the vapor-absorption cycle in 1850. All mechanically produced cold today is based on one of these technologies. By inference, then, this includes, cooling/freezing with liquid or solid gasses, as they must first be chilled by one of the mechanical means. By the early 20th century home-based refrigeration became a commercial success, quickly replacing "ice box" refrigeration.

At about the same time, in the late 1920's, Clarence Birdseye conceived a means of commercially freezing foodstuffs, which also preserved taste. His patents resulted in what we know today as "TV Dinners," and other frozen foodstuffs. What Birdseye realized in the 1920's was that to properly freeze foods for later consumption, they must be frozen quickly {flash freezing is probably the best term to describe this method today, and is used herein in reference to this effect} at very low temperatures. His numerous patents in that era focused on how to flash freeze foods on an assembly line. He started with the need to "quickly" freeze fish in order to preserve the integrity and quality {i.e. taste} of the comestibles upon thawing and subsequent consumption.

More to the point of this concept, he states in U.S. Pat. No. 1,773,079 issued in 1930 that . . . "In the case of fish or meat, for instance, slow freezing disrupts the cells of animal tissue, with loss of the pristine qualities and rapid deterioration after thawing." He goes on to state how his process will enable the economical commercial delivery of comestibles to the consumer. These observations were made in the 1920's, and there is still no similar solution for the consumer.

Today, all commercially produced frozen foodstuffs are flash frozen. That is easy to state, because if they weren't, consumers would reject them! Many vegetables are flash frozen within hours of domestic harvesting. Similarly, many seafood products are flash frozen on the boat, again within hours of being caught. Clearly, Birdsey's observations of the 1920's have become a reality today.

Freezing foodstuffs by any means will safely preserve it for longer term storage . . . flash freezing also preserves taste. The embodiments presented here empowers the consumer to flash freeze foodstuffs at home.

Speaking of the consumer, their tastes are changing. According to a story on Marketplace (11 Mar. 2015—marketplace.org), the millennials are fed up with processed foodstuffs. Rather than put up with all of the additives in processed foodstuffs, they are learning to cook from scratch and avoid additive laced processed meals. Unfortunately in most areas of the country locally grown produce is only available a few months of the year. This leaves them with the dilemma of how to preserve it (i.e. . . . the taste).

Revolutionary Home Freezing Apparatus

The Sub-0 Home Freezer is a revolutionary new appliance for the home cook to use to prepare foods for long term cold storage. Based on the principles first observed by Clarence Birdseye in the 1920's, the Sub-0 Home Freezer is a small counter top appliance, about the size of a microwave oven, powered by a scaled down refrigeration engine tuned to deliver temperatures necessary to flash freeze foodstuffs. The standard home refrigerator/freezer is perfectly capable of safely preserving foodstuffs for short term in the refrigerator compartment and indefinitely in the freezer compartment. It is not suited to initially freezing foodstuffs for long term storage. Such a system has not been available to the consumer.

The web site referenced above, "stilltasty.com" is focused on the shelf life of our food supply. Of specific interest here, is the shelf life of perishables. Consider their recommendation for fresh pork chops: in refrigerator for 3-4 days, and the home freezer 4-6 months. They add that meat maintained at 0° F., is safe to consume indefinitely, however taste may have deteriorated. Personal experience with flash frozen pork chops has shown no degradation in taste after six months, and by accident, even after two years.

The Sub-0 Home Freezer is an adjunct to the home freezer. Except for the picnic cooler or air conditioner, refrigeration systems are designed to operate continuously and maintain predetermined temperatures. Clearly many economies can be achieved by scaling down the freezing system for a single purpose as presented here. What exists today are large walk in commercial installations, lab freezers, multi-temperature home freezers {including some with built in flash freezers}, and dorm fridges. The first two are not suited for the home market. For consumers considering a new appliance, the next approach would achieve the desired result for the home, but at the added expenses of both initial cost and operation. Finally, dorm fridges meet the cost objectives, however have difficulty freezing ice cubes. The Sub-0 Home Freezer, then empowers the consumer with the same and proven technique for preserving the taste of foodstuffs enjoyed by the large commercial food manufacturers for nearly a century.

The Sub-0 Home Freezer encompass a cost effective system designed specifically for the home to initially freeze foodstuffs for longer term storage in their home freezer. This unique flash freezer is intended for occasional use, like the consumer's oven or microwave oven. Thus, the Sub-0 Home Freezer will do for food preservation what the microwave has done for food preparation in the home.

Terminology in the Literature

A review of the state of the art pertaining to lower temperature freezers turns up many references misusing technical terms. Terms like: brine, a saturated salt water solution; cryogenics, the study of temperatures ranging from −150° C. (−238° F.) to absolute zero; ultra low temperature, generally refer to laboratory freezers that continuously and precisely maintain temperatures at or below −40° F.; flash freezing, {or blast freezing} as used here means foodstuffs quickly frozen by subjecting them to temperatures substantially below 0° F.; however there are frequent references to flash freezing by subjecting materials to cryogenic temperatures. Although dry ice −78° C. (−108° F.) would produce the desired results as discussed herein, it is inconvenient, expensive, has a short usable life. Further it could prove hazardous, as it can easily "burn" the skin when handled improperly, by the typical consumer. One final term—low temperature freezing would seem to be just what we are looking for, yet upon a Google Search, the results revolve around continuous use laboratory and commercial, very low temperature freezers operating at temperatures below −40° C. and very costly. The cost is justified for institutional applications, because it is a function of extra insulation, superior door seals and precision control systems, locks, alarms and data loggers necessary for these demanding applications.

Failure of Various Previous Attempts to Satisfy Consumer Needs

Prior art patents are rife with improvements for low temperature refrigeration systems. The patents range from improvements to refrigerants, organization of materials on a pallet or conveyor belt to better achieve rapid removal of heat, and novel approaches to immersing the material in the cooling fluid. These are intended for commercial applications and not discussed here.

Three novel approaches to achieving flash freezing in the home are: Yamada—U.S. Pat. No. 7,628,029, Fumagalli—EP 1074803, and Marega—EP 1457748. All have serious limitations for the home market. First, they do recognize the need for sub-0 temperatures. To effect the lower temperatures they add a "third" flash freeing chamber to the common home refrigerator. This approach necessitates the purchase of a major new appliance. That is to scale up, not scale down as presented herein.

Yamada's first embodiment employs two or more "brine" bags wherein the foodstuff is placed in between these bags in a home freezer to enhance the heat transfer and thus improve the subsequent quality of the foodstuff after freezing. However, although the brine bags enhance the heat transfer they do not reduce the freezer compartment temperature and large ice crystals could still form. Recognizing this, Yamada further proposes a significant modification to home freezers, by adding a third chamber at a lower temperature than traditional freezers.

Another example is the EU 1074803 A2 patent by Fumagalli. He too recognizes the need to reduce the temperature of foodstuffs quickly in order to avoid formation of large ice crystals. To accomplish this, like Yamada, he incorporates a third chamber operating at the necessary lower temperature to achieve flash freezing. He doesn't bother with brine bags; rather he adds a second refrigeration engine, inside the freezer.

Finally, Marega employs an enclosed freezer compartment within the main freezer space. Further he proposes maintaining this second compartment at a flash freezing temperature. To accomplish this he proposes any of the methods used in a typical home combination refrigerator/freezer. This is an excellent concept for a standalone freezer; however, it would take up too much space in a combination unit. To put that in perspective, consider two boxes the size of an ice maker inside your freezer compartment. Unlike the above concepts, the EPA Energy Star rating shouldn't be severely impacted.

Two additional patents of interest here are: U.S. Pat. No. 7,810,340 B2, by Owada; and U.S. Pat. No. 6,397,620 B2, by Kelly. The former presents an approach to facilitate flash freezing for foodstuffs on a commercial scale. The reason for discussing it here isn't because of their methods, rather the electron microscope images they present. These images corroborate Birdeye's teachings. Birdseye made two key observations, in the 1920's, on the benefits of flash freezing. First, it prevents formation of large ice crystals in the foodstuffs cell structure {clearly depicted in the photos therein}. Although interesting, not of value until you appreciate the more important observation . . . flash freezing also preserves taste.

Kelly discusses the use of VIP's (vacuum Insulation panels) for optimizing the thermal efficiency of his ultra-low temperature freezer cabinet. The advantages are, reduced cabinet size or increased interior space, because of the high thermal efficiency of a vacuum. As discussed later, the problem is maintaining that high level of vacuum over time by simple means, other than costly components like VIP's. As we are dealing with much higher temperatures for very short duty cycles "dead air" is sufficient.

Clearly these inventors recognize the need to develop significantly lower temperatures to properly flash freeze. They are using Birdseye's teachings, that flash freezing necessitates substantially lower temperatures, in order to preserve taste, for the consumer market. However, these solutions require the purchase of a major new appliance and could substantially increase operating costs. Obviously the EPA Energy Star rating would not be easy to obtain. Although the technology has been available to those skilled in the art, they have not thought to scale down a refrigeration system from a continuous use home appliance to a small counter top, intermittent use freezer as described herein.

Consumer's Options Today

Aside from the methods described above, there are no other options for the consumer, targeted at preventing the formation of large ice crystals, i.e. flash freezing. There are many work a rounds suggested in the literature and products toted to improve the results of long term food freezing preparation for home use.

Both government agencies and consumer groups recognize the limitations of home freezers, and suggest clever work-a-rounds. For example, place the items to be frozen in small thin groupings, and distribute around the freezer compartment. Clearly, the intent here is to simulate flash freezing . . . at 0° F.!

And there is the brine method described by America's Test Kitchen, as a "Quick Chilling" work around. In addition they recommend further precautions of wrapping the foodstuffs in a combination of plastic wrap, then aluminum foil, and finally placing it in a plastic bag, or to vacuum seal it. My test results show that placing the foodstuffs in a plastic bag and flash freezing, preserves taste for at least two years.

Food storage product marketers would have you believe that bigger is better. That is to say their thicker "freezer bags" or containers will improve the results. Although these items may minimize surface frost formation, more commonly known as freezer burn, they have no affect on cell damage. Additionally, these products can easily double the costs of food storage products.

Another angle promoted by these manufacturers is that excess air in the container is the cause of short shelf life in the freezer. Thus, they offer a vacuum machine and bags that completely evacuates all air in the container. These devices focus on consumer fears of foodstuffs degradation in the freezer because of excess freezer burn. Again, the damage is already done when freezing at 0° F.!

These approaches add cost for the consumer with minimal benefits. The only means of preventing cell damage, and thus degradation of taste, is flash freezing. The micro-photos in the "Owada and Saito" patent clearly show the scientific evidence on the necessity of much lower temperatures than available in the home today. These photos simply corroborate Birdseye's microscopic observations of the 1920's.

Thus today, consumers concerned about preserving the taste of frozen foodstuffs are left with two options. They can buy a new appliance or buy commercially frozen foodstuffs. The former incurs a major expense, the latter comes with many issues. Commercially frozen products, known as "processed" foods, contain many undesirable additives. With the increasing popularity in "farmer's markets," and grocery store sales on preferred foodstuffs, the consumer is left with the options of either consuming immediately or accepting the reduced taste upon freezing, and subsequent thawing.

Because of time factors, many families will cook ahead meals intended for consumption later in the month. Unfortunately there is a substantial loss of taste when frozen in the home freezer. Another reason families want to prepare meals ahead is that they have a quick, healthy meal on one of those busy nights. These families like to prepare their favorite recipe and virtually make their own T.V. dinners, using only the ingredients they choose, leaving out additives, preservatives and other undesirable ingredients. Consider the plight of the shopper (Ref. "Six Chix") at the grocery store where the shelves are nearly empty. The problem, the store clerk explains . . . "We stopped carrying processed foods that contain added sugar."

There is a strong movement in America today towards locally grown, sugar free, reduced sodium, gluten free, additive free, etc. Locally grown is great, it insures freshness, eliminates excess transportation costs, and many other factors, but these foodstuffs have very short shelf life. For many of these foods, canning and preserving is a great solution. In addition to a short shelf life, these locally grown foods have a limited growing season. Yes, green beans can be canned, but they taste much better when flash frozen. Just compare canned beans versus commercially flash frozen. The frozen beans are bright green, crisper and taste better.

When the consumer is empowered to flash freeze their own recipes, the sky is the limit. Now the consumer can prepare meals ahead, and be assured of an appealing taste when it is served to the family at a later date. That is to say we can enjoy the taste of "mom's home cooking" now and later. Further, people on special diets can prepare their own specialized recipes and flash freeze them for later use. Commercially manufactured TV dinners are a great convenience . . . loaded with additives considered undesirable by many.

One of our family favorites is pork chops, a simple cut of meat that frequently goes on sale. As an experiment, I prepared a pork loin cut into chops, freezing half of them traditionally in the home freezer and flash freezing the other half. Several months later we cooked them as we would normally. Each chop was identified, but how it was frozen was not revealed. After only a couple of bites, my picky grandsons would only eat the flash frozen chops, because of the obvious taste difference and they looked more appealing. Over a year later some of those flash frozen chops were cooked along with some fresh ones. Again, according to my grandsons, the flash frozen chops were as good as those just purchased. Confirming the notion that once foodstuffs are flash frozen they retain their texture and taste remarkably well when stored in the home freezer.

Again, the Sub-0 Home Freezer is an adjunct to the home freezer. When needed, simply turn on, use, and set aside until needed again. This scaled down flash freezing appliance will revolutionize how America eats! Which is exactly what Birdseye accomplished according to Steven Jhonson.

Advantages

For nearly a century the processed food manufacturers have recognized the advantages of flash freezing foodstuffs to preserve taste. Accordingly, one or more aspects of the embodiments described herein, would empower the consumer to effectively preserve their own recipes for longer-term storage. They could do this just like the big guys, but at home using their own recipes and appliance. These foodstuffs could include sale items purchased at the local market or from the ever more popular "grown locally farmer's market movement." Furthermore, the homemaker can knowingly prepare homemade meals, incorporating their personal menu preferences, to be consumed at a later date without loss of taste or quality. Many consumers are additive averse, have allergies, dieting, or have numerous other issues with processed foodstuffs. Foodstuffs need to be flash frozen, as recognized by the industry leaders since the 1920's, to preserve their taste and quality upon subsequent thawing and consumption, an option heretofore not economically available to the consumer.

The essential advantage proposed in these embodiments, is to offer the consumer a low cost solution to the problem of effectively preserving foodstuffs by introducing an economical, low cost, low temperature {substantially below 0° F.} freezing system. Traditional home refrigerators provide a storage compartment maintained at 4° C. (40° F.) and a freezer compartment maintained at about −18° C. (0° F.). Both temperatures have been determined to be the necessary base for preserving foodstuffs from a few days to much longer in the freezer. However, these temperatures are not adequate to initially freeze foodstuffs for long term storage. As the commercial manufacturers have recognized for many years, foodstuffs must be quickly frozen at temperatures substantially below those available to the consumer, unbeknownst to the consumer.

SUMMARY

Commercially prepared foodstuffs typically contain undesirable additives that our increasingly health conscious population prefers to avoid. The food industry defends these additives based upon scientific research regarding what consumers will eat. The problem, addressed here, is that of empowering the consumer to preserve the taste of mom's home cooking.

Thus, this invention presents a small self-contained refrigeration unit dedicated to just flash freezing. Clearly, flash freezing has been demonstrated as the means of preserving taste for nearly a century. Although mechanical refrigeration technology has been refined over the years, to with the numerous enhancements in the art presented in the literature, no attempts have been made to scale down a refrigeration engine dedicated to flash freezing for home use. Simply stated, those skilled in the art of refrigeration design, have not considered the potential revolutionary effect the Sub-0 Home Freezer will have for the consumer!

Specifically, as a sufferer of hypertension, I need to limit my salt intake to under 1500 mg per day. Most TV diners exceed 1000 mg, which is well over half of my daily target. The homemaker has the choice of either serving these ready-made meals, with unhealthy additives, or making meals from scratch and then freezing for later consumption. The later approach, unbeknownst to the consumer, is not appealing due to the limitations of the homemaker's refrigeration system.

While the home freezer can safely preserve foodstuffs for longer-term storage, it is not suited for the initial freezing step; that of flash freezing foodstuffs for subsequent longer-term storage. Freezing foodstuffs in the home freezer allows large ice crystal formation that adversely affects taste. While the consumer can safely make meals for later use, they are not able to effectively preserve the desired taste.

Design Philosophy

Good design depends upon three basic elements: 1—Functionality—does it perform the stated objective, 2—Simplicity—Can it be manufactured at low cost, with high reliability, and 3—Elegance—is it pretty, will it attract the consumer.

Elegance is left for another discussion, that leaves functionality and simplicity. Functionality, that of developing sub-0 temperatures, can be achieved by various approaches, there are numerous teachings in both the art and literature. A specific layout of the Refrigeration Engine (70) components are shown to demonstrate a viable approach, but by no means, the only implementation. The art of refrigeration is over a century old, and well understood by skilled practitioners. The key element, here then, is to configure a diminutive refrigeration system with the sole objective of flash freezing a quantity of foodstuffs (42). This line of thinking leads the designer to approaches heretofore not considered.

Birdseye in his teachings, focused on the mass production of flash frozen foodstuffs. Numerous others have embellished his ideas. As discussed earlier, there have been various attempts at providing sub-0 temperatures for the domestic market. These attempts have failed, primarily based on cost . . . both investment and operational . . . costs to the consumer.

The medical and scientific communities are interested in temperatures at or well below those necessary to realize flash freezing. They however, have additional restraints, factors such as precision control, stable temperature maintenance over extended periods of time, and frills like door locks and data loggers. These restraints significantly affect cost and mass, and thus are beyond the reach of the consumer.

Table of Part Reference Numbers

| Item # | Description | Item # | Description |
|---|---|---|---|
| 10 | Enclosure | | Prior Art Components |
| 20 | Cover | 70 | Refrigeration Engine |
| 21 | Lid | 71 | Compressor |
| 30 | Base | 72 | Condenser |
| 31 | Base Plug | 73 | Evaporator |
| 40 | Foodstuffs Tray | 74 | Expansion Device |
| 41 | Cold Chamber | 75 | Refrigerant Line |
| 42 | Foodstuffs | 76 | Refrigerant Flow |
| 50 | Insulation Channel | | |
| 61 | Power Switch | | |
| 62 | Status Indicator(s) | | |

DETAILED DESCRIPTION

Figure 1:
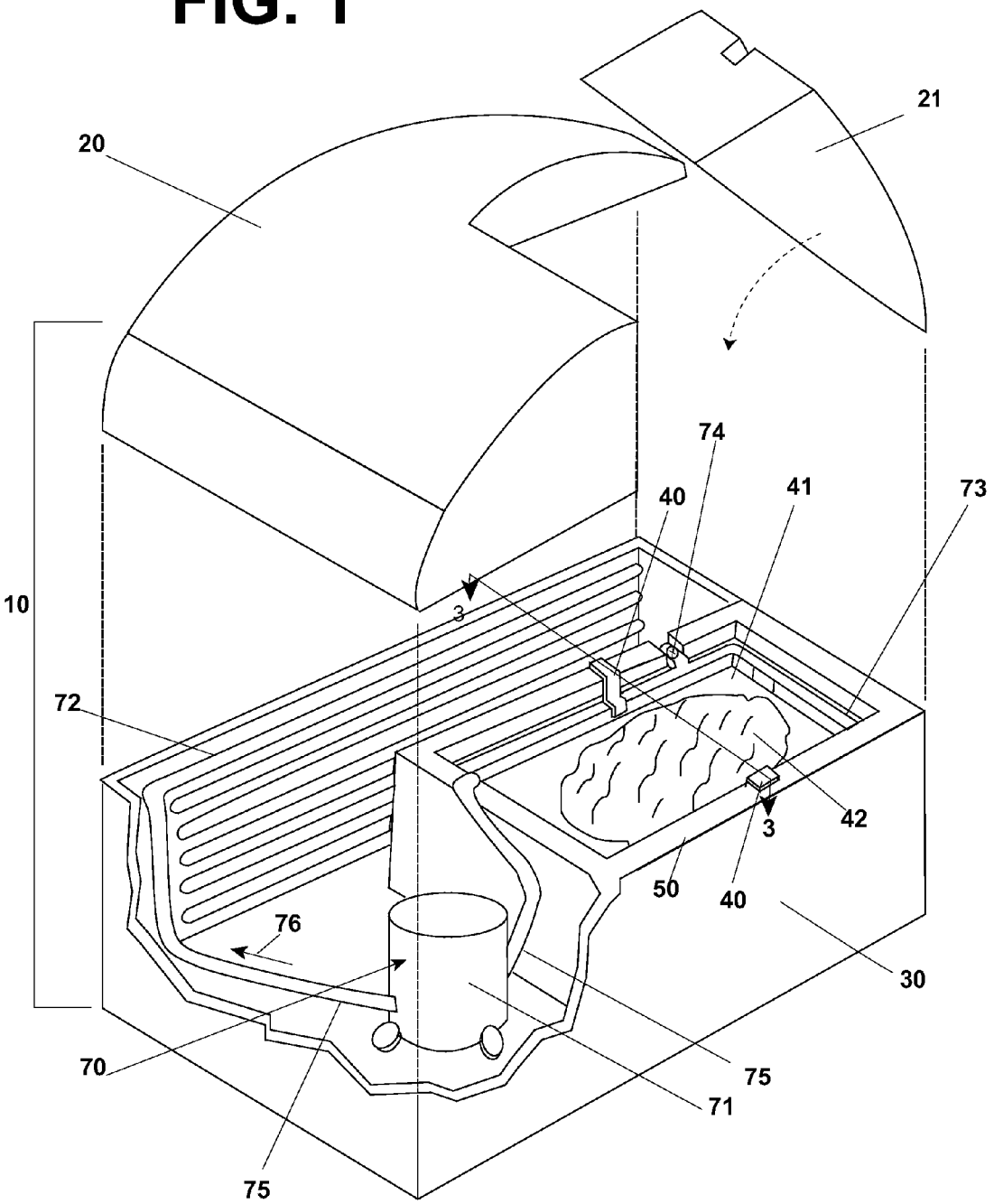
FIG. 1 is an exploded perspective view of the present invention with the top separated and the bottom cut-away providing insight of internal details.

Referring to the figures and table of reference numbers above, the Sub-0 Home Freezer is comprised of an enclosure, to contain and fix in place all components, and a conventional refrigeration engine (70) to remove heat. The engine is shown to present the interrelation of the various components. Depicted are: the compressor (71), condenser (72), evaporator (73), expansion device (74)—shown as a "X" in a circle, refrigerant line (75), and refrigerant flow direction (76). Not shown are fans, controls, or power cords.

Figure 2:
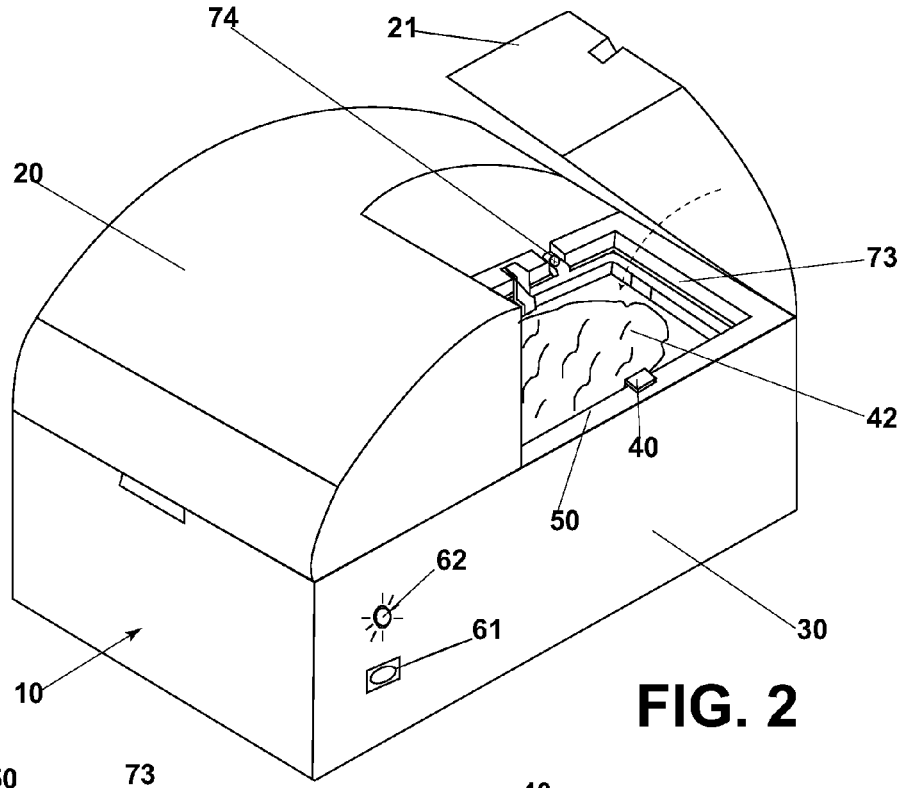
FIG. 2 is a rendering, in perspective, of the counter top flash freezer for the home, in accordance with an embodiment of the invention, and showing all user accessible areas.

The Enclosure (10) consists of the Cover (20) secured to the Base (30), and Lid (21). The Lid (21) is shown as hinged on the right, in the open position, however it could be attached at various other locations, or just be a loose item. Preferably, the enclosure would be molded in plastic, to accommodate its various functions. Further, FIG. 2 shows all user accessible areas. The Cold Chamber (41) is a spatial area encircled by the Evaporator (73) which in turn is encircled by the Insulation Channel (50). An example item of Foodstuffs (42) is situated in the Cold Chamber (41) and resting on the Foodstuffs Tray (40). The tray serves limit direct contact of the foodstuffs with the Evaporator (73) while facilitating loading and removal of the Foodstuffs (42). In addition, this tray minimizes the user to exposure of the very cold Evaporator (73) surface, and facilitates clean up.

In order to achieve flash freezing, the cold chamber (41) must attain a temperature substantially below 0° F., and then reasonably maintain that temperature during the brief period of operation. To attain this temperature, those skilled in the art have many choices of refrigeration engine components, parameters and refrigerants that will develop the desired temperature in the Cold Chamber (41). The designer may offer the user a fixed state one temperature system or offer the user various settings to choose from depending upon intended use. Much like the popcorn or baked potato choices on microwave ovens.

Figure 3:
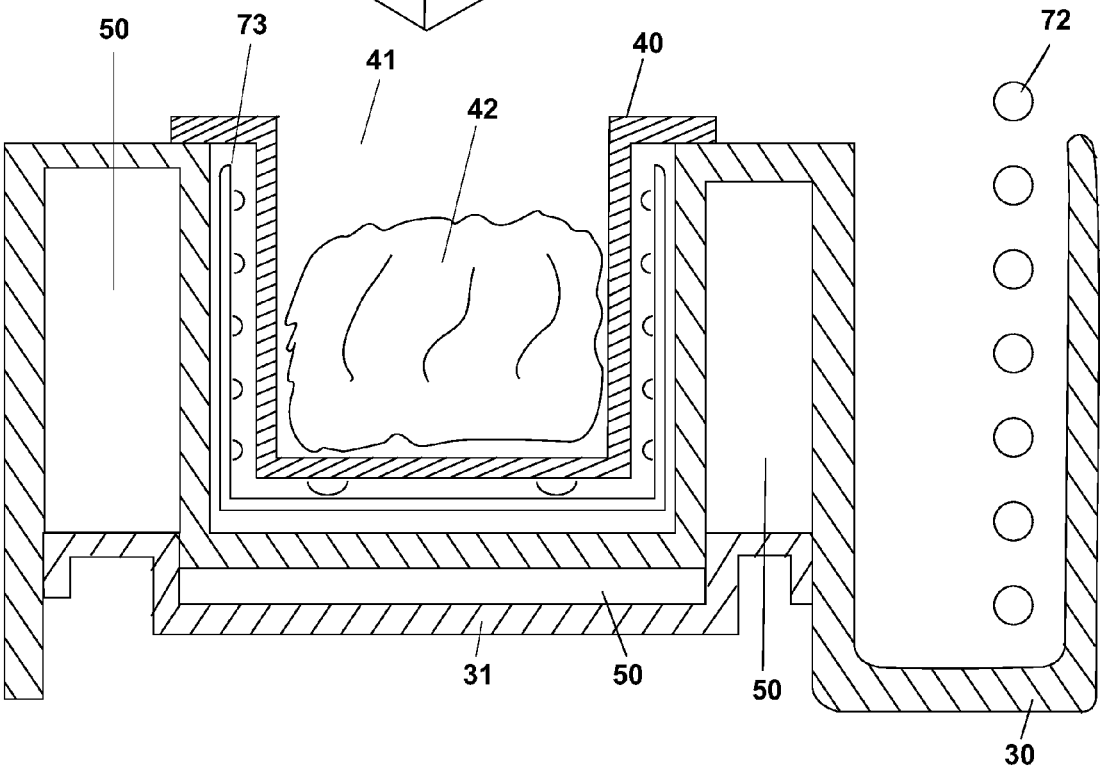
FIG. 3 is a sectional view of the lower portion of FIG. 2 illustrating internal details of the cold chamber (41), insulation channel (50) and related components, taken along line 3-3 of FIG. 1.

Secondly, the efficiency of the system is further enhanced by effectively insulating the cold chamber (41). FIG. 3 is a sectional view from front to rear of the, along line 3-3 thru the Cold Chamber (41) and adjacent components. The Foodstuffs (42) are situated on the Foodstuffs Tray (40) which in turn is encircled by the Evaporator (73). The Evaporator (73) is in turn encircled by a portion of the Base (30), forming a channel. Upon assembly of the Base Plug (31) to the Base (10) a sealed chamber is formed. This in-turn forms an Insulation Channel (50), which completely encases the Evaporator (73) on five sides. Thus forming a thermal insulator comprised of dead air. Dead air (i.e. still air) is on par with urethane foam insulation; and is both free and lower mass. The chamber's insulating properties could be further enhanced by creating a partial vacuum at assembly. While thermal conductivity approaches zero as the level of vacuum is increased, maintaining the vacuum over time may require more sophisticated materials and assembly methods than the added cost would warrant.

Operational efficiency is further enhanced by a vertical (as shown) or near vertical orientation of the Cold Chamber (41). This orientation takes advantage of cold air being heavier than warm air.

Considering this is specifically an occasional use appliance, it is assumed the user will desire to move it to a storage area when not in use. Thus emphasis is placed on mass and size. Portability implies both minimal weight and size. Not shown, but features like a non-skid base or handles could be added for user convenience. The essence here then is a scaled down flash freezing system which has not been described by prior art or in the literature.

The Switch (61) and Status Indicator (62) are mounted on the Base (10), away from the Insulation Channel (50), so as not to compromise the integrity of the insulation channel. A power cord and electrical controls are assumed.

Other components and/or orientations may produce similar results that skilled practitioners could choose to employ. Clearly advanced features, such as temperature sensors, ready/done indicators, and timers could be incorporated to enhance marketability or improvements as desired.

Traditional thinking about any refrigeration device is that it would require two men and a dolly to move. By scaling down all aspects of the Sub-0 Home Freezer, mass has been removed to facilitate the concept of a portable counter top freezer. The biggest factor for scaling down a freezer is the size of the Cold Chamber (11). Considering the Sub-0 Home Freezer is intended to freeze small quantities at a time, the user can do this in several iterations. Thus, the Cold Chamber (11) can be diminutive. That causes a cascade effect. Now the condenser and compressor are respectively reduced in size and mass. The later being most significant here.

Other mass factors include the: cabinetry {i.e. the Base (10) and Cover (20)}, which as described here are molded plastic, and hence orders of magnitude lower mass than steel. Probably air is the lowest mass attainable for its insulating properties in this type application. Not just any form of air, rather what is referred to in the art as dead air. That is stagnate air.

CONCLUSIONS AND RAMIFICATIONS

Thus the reader will see that the above embodiments provide the consumer with a refrigeration system heretofore unavailable to them. The concepts presented offer the consumer a revolutionary new and effective means of preserving foodstuffs for later use.

While the above description contains many specificities, these should not be construed as limitations on the scope, but rather an exemplification of the several embodiments described thereof. Many other variations are possible. The indicator and switch could be a simple elements, as shown, or multifunction devices. For example, there could be multiple lights or a digital display, while the switch could offer the user various settings for preparing a particular type of foodstuffs, or the system could be started by simply plugging into an electrical outlet. These features could be added as marketing features. For example, the system could be powered by a battery or a flame, rather than house current. Additionally, rather than a hinged door, the closure could be a cover similar to that of a picnic cooler. Scientific and medical laboratories may find the simple operation ideally suited for quick and low cost sample preparation.

Accordingly, the scope should be determined not by the embodiments illustrated, but by the appended claims and their legal equivalents.

I claim:

1. A domestic portable countertop flash freezer for initially freezing foodstuffs prior to long term storage in a home freezer comprising: a) an enclosure having a storage area, a cover, a cold chamber, a lid, and a base portion; b) a refrigeration engine having a compressor, a condenser and an expansion valve disposed within the storage area and an evaporator disposed within the cold chamber; c) the base portion including an L-shaped interior sidewall defining an interior space and dividing the interior space to define the cold chamber and the storage area; d) the cold chamber including a base plug extending between the L-shaped interior sidewall and a first wall of the cold chamber and a second wall of the cold chamber and an exterior wall of the base portion, creating an insulation channel of dead air between a bottom of the cold chamber, the L-shaped interior sidewall and the first wall of the cold chamber and the second wall of the cold chamber and an exterior wall of the base portion; e) the cover fixed to the base portion and enclosing the storage area; f) the lid removably positioned over and covering the cold chamber; g) the refrigeration engine maintaining the cold chamber at a temperature below 0° F. for flash freezing a single portion of foodstuffs; and h) the flash freezer being configured for hand carrying by a user.

2. The domestic portable countertop flash freezer according to claim 1, further including a power switch for activating and deactivating the freezer for controlling operational time and energy consumption upon completion flash freezing operation.

3. The domestic portable countertop flash freezer according to claim 1, further including status indicators for indicating state of operation of the flash freezer.

* * * * *